United States Patent [19]

Ellert

[11] 4,355,493

[45] Oct. 26, 1982

[54] ROLLER CHUTE

[75] Inventor: Roger H. Ellert, San Clemente, Calif.

[73] Assignee: Scholle Corporation, Irvine, Calif.

[21] Appl. No.: 160,556

[22] Filed: Jun. 17, 1980

[51] Int. Cl.[3] ..... B65B 39/00; B65B 5/04

[52] U.S. Cl. ..... 53/113; 53/530; 53/258; 53/390; 193/35 R

[58] Field of Search ..... 53/259, 390, 258, 255, 53/530, 449, 113; 193/35 R, 35 TE, 2 R, 2 D, 38, 41

[56] References Cited

U.S. PATENT DOCUMENTS

| | | | |
|---|---|---|---|
| 2,403,149 | 7/1946 | Williams et al. | 53/255 |
| 2,724,629 | 4/1973 | Collins | 193/35 R |
| 2,821,828 | 2/1958 | Kernen, Jr. | 53/258 X |
| 3,445,985 | 5/1969 | Manetta | 53/530 |
| 3,456,861 | 7/1969 | Wettlen | 53/449 X |
| 3,473,291 | 10/1969 | Raymond et al. | 53/530 |
| 3,541,758 | 11/1970 | Welborn | 53/255 X |
| 3,631,916 | 1/1972 | Schwartz | 193/35 R X |
| 3,792,564 | 2/1974 | Brady, Jr. | 53/530 |

FOREIGN PATENT DOCUMENTS

| | | | |
|---|---|---|---|
| 2028252 | 3/1980 | United Kingdom | 53/530 |

*Primary Examiner*—Horace M. Culver

*Attorney, Agent, or Firm*—Knobbe, Martens, Olson, Hubbard & Bear

[57] ABSTRACT

A roller chute apparatus for packaging a flexible plastic bag filled with liquid in a box has four stacks of rotatably supported vertically spaced rollers. The four stacks extend a substantial depth into the box around the inside of the box sidewalls forming two pair of mutually opposing stacks. A first pair extends above the open top of the box and cooperates with the second pair in guiding the bag into the box. The second pair extends above the top of the box with opposing stacks being mutually spaced a greater distance than opposing sidewalls of the box, thereby forming a funnel-like opening with the first pair. A driver roller is substantially located above and adjacent to the top of the box forming an angular transition between each of the portions of the second pair extending above and below the top of the box.

2 Claims, 5 Drawing Figures

Fig. 1
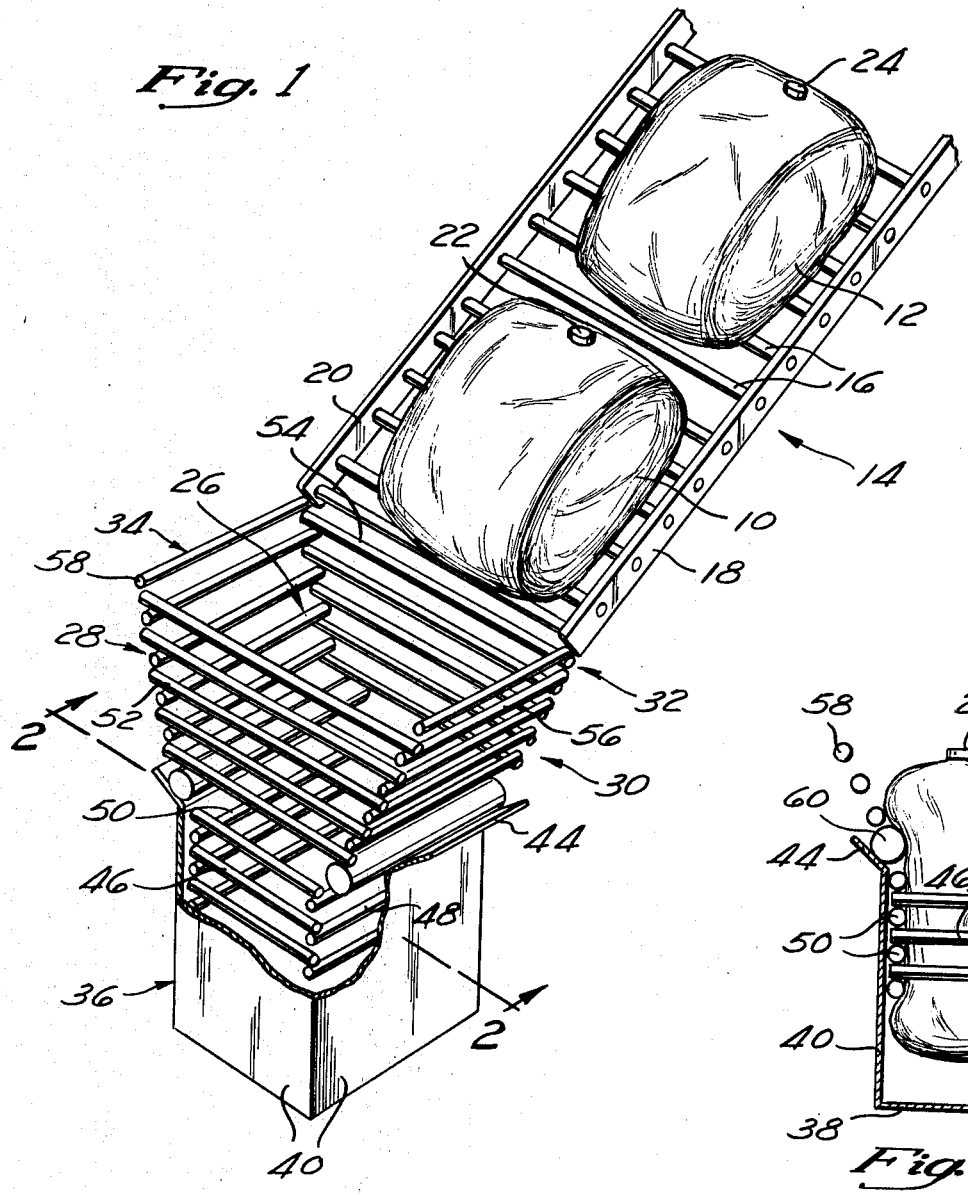
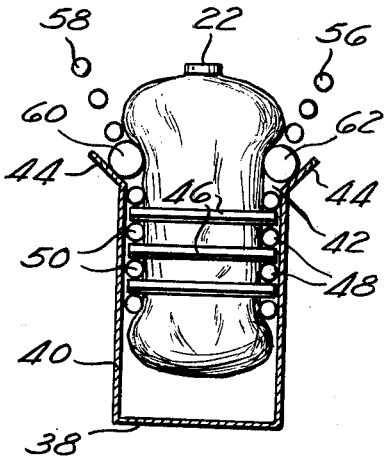
Fig. 2
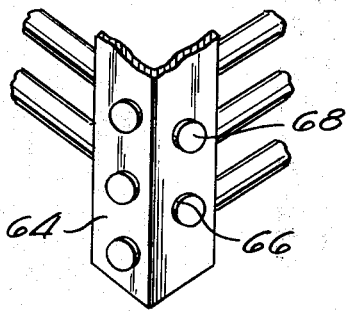
Fig. 3
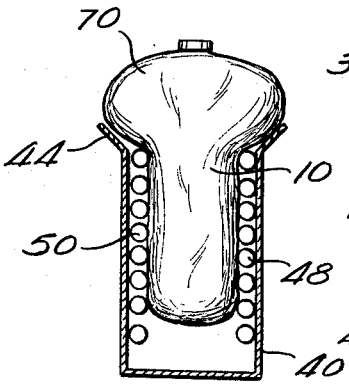
Fig. 4
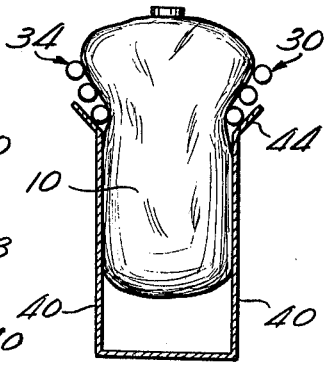
Fig. 5

ROLLER CHUTE

BACKGROUND OF THE INVENTION

The invention is generally related to an apparatus for placing flexible packages in a rigid container. More specifically, the invention relates to a roller chute which packages flexible plastic bags filled with liquid such as syrup or milk within a rigid box.

A container presently becoming more widely used for dispensing fluids, such as milk, consists of a thin-film plastic forming bag within a cardboard box. The plastic bag is filled with a liquid which is dispensed through a spout opening in the bag.

The present invention is directed toward the problem of packaging such plastic bags within their cardboard boxes. The packaging raises unique and difficult problems due in large part to the fact that the liquid in the plastic bag will tend to expand in any direction in which it is not constrained. Thus, the bag having a relatively amorphous shape must be packaged within the determinate volume of the rigid cardboard box.

Clearly, the box could be made large enough relative to the size of the bag to permit the bag to be simply dropped into the box without the aid of any apparatus. However, this would represent a substantial waste of resources in providing such an oversized box.

In one previously employed method, the filled bags are stuffed into the boxes by hand in a slow and uneconomical packaging process. In addition, many different types of packaging apparatus have been developed in the past, but none satisfy the unique requirements for packaging and handling flexible bags filled with liquid. There is, therefore, a definite need for a packaging apparatus which will provide a continuous and cost effective means for packaging flexible bags within rigid containers.

SUMMARY OF THE INVENTION

The inventive apparatus is a roller chute for packaging in a flexible bag filled with liquid in a box having an open top, bottom and four sidewalls. The chute comprises four stacks of rotatably supported, vertically spaced rollers. Each stack has a lower portion extending into the box a substantial depth along a corresponding sidewall forming a first and second pair of mutually opposing stacks. Advantageously, the depth each lower portion extends into the box is about one-half the height of the box. The axes of the rollers of each of the lower portion stacks forms an essentially vertical plane.

The first opposing pair of roller stacks has an upper portion extending vertically upward above the top of the box to guide the bag into the top. The second opposing pair of roller stacks has an upper portion extending above the top of the box with opposing stacks being mutually spaced a greater distance than the corresponding opposing sidewalls, thereby forming a funnel-like opening with the upper portions of the first pair. The corresponding upper and lower portions of each stack of rollers of this second pair are therefore laterally spaced and form a junction above and proximate to the top of the box.

A driven roller is located substantially at each junction forming an angular transition between corresponding upper and lower portions of the second pair and is positioned to maximize its surface area contact with the bag as the bag is guided through the top. Advantageously, these driven rollers have a diameter at least twice as large as the diameter of the rollers in the lower portions of the four stacks.

Thus, the rollers above the top of the box guide the bag into the box and form it to the box shape. The bag is oriented so that the spout opening in the bag will be positioned upward after the bag is packaged. The driven rollers urge the bag into the interior of the box. Importantly, the rollers within the box reduce the friction between the bag and the sidewalls of the box.

The inventive apparatus therefore provides a cost efficient and continuous system for packaging such flexible bags within their respective cardboard containers.

BRIEF DESCRIPTION OF THE DRAWINGS

These and other advantages of the invention will be clarified and discussed below with reference to the drawings in which:

FIG. 1 is a perspective view of the roller chute apparatus partially cut away to show the rollers within the cardboard container;

FIG. 2 is a sectional view taken through line 2—2 of FIG. 1 showing the bag partially packaged within the box;

FIG. 3 is a fragmentary perspective view of the supporting structure for the rollers;

FIG. 4 is a sectional view illustrating the inability of the bag to descend to the bottom of the box if the rollers extend down the entire length of the box; and FIG. 5 is a sectional view illustrating the increased friction which occurs between the walls of the bag and the sidewalls of the box if the rollers do not extend down within the box.

DETAILED DESCRIPTION OF THE PREFERRED EMBODIMENT

Referring to FIG. 1, plastic bags 10 and 12 are shown supported by a conveyor 14. The conveyor 14 is composed of a plurality of idle rollers 16 connected between opposing side frames 18 and 20. The conveyor 14 is inclined so that the bags 10,12 descend by gravity downward along the idle rollers 16.

Each of the bags 10,12 has a sealed spout 22,24 through which the fluid in the bag can be dispensed. The bags 10,12 are formed of thin film plastic which is flexible to allow the bags to collapse with the fluid level as fluid is dispensed through the spouts 22,24. The bags 10,12 are filled with a liquid, such as milk, wine, or syrup. Since the bags 10,12 are flexible, the liquid within them will expand in any direction in which it is not constrained. Thus, the bags 10,12 represent a relatively amorphous mass which creates unique problems in packaging.

The conveyor 14 leads into an opening 26 formed by four stacks of idle rollers 28, 30, 32, and 34. Each stack of idle rollers 28, 30, 32, and 34 extends downward into a box 36. Adjacent stacks of rollers are mutually perpendicular and form an enclosed cage-like structure. The stacks 28, 30, 32, and 34 can conveniently be referred to as two pair of mutually opposing stacks of rollers. The first pair of mutually opposing rollers is composed of stacks 28 and 32 and the second pair of mutually opposing rollers is composed of the stacks 30 and 34.

Referring to FIGS. 1 and 2, the box 36 is shown having a bottom 38 and four sidewalls 40. The adjacent sidewalls 40 are mutually perpendicular and join the bottom 38 at right angles. The upper ends of the sidewalls 40 form an open top 42. Each sidewall 40 extends upward into a foldable flap 44. The four foldable flaps 44, when folded inward and parallel to the bottom 38, will form a closed top.

The box is typically made of cardboard and is therefore relatively rigid with respect to the flexible plastic bag 10. The volume of the box 36 is designed to be as small as possible and yet permit the box 36 to contain the bag 10. In one preferred embodiment, the box has a square bottom five and one-half inches by five and one-half inches with sidewalls eight and one-half inches in height. Such a box adequately accommodates a plastic bag having a volume of approximately four liters. In another preferred embodiment, the dimensions of the box are eight and one-half inches by nine inches by twelve inches, and accommodate a bag having a volume of approximately five gallons.

The roller stack 28 has a lower portion of idle rollers 46 which extends from the open top 42 down into the interior of the box 36. Similarly, the stacks 30 and 34 have a lower portion of rollers 48,50 which extend from the open top 42 and extend down into the interior of the box 36. It should be understood that the stack 32 also has a lower portion of rollers extending downward into the interior of the box which is not shown in the drawings. All discussions of the lower portions 46, 48, and 50, made hereafter, applies equally as well to the lower portion of the stack 32 which is not shown.

Each of the lower portions of rollers 46, 48, and 50 are located inside and adjacent to corresponding sidewalls 40 and are composed of vertically spaced idle rollers whose axes form an essentially vertical plane. In the preferred embodiment, each of the lower portions 46, 48, and 50 extend to a depth of about one-half the height of the box 36.

Each of the first opposing pair of rollers formed by the stacks 28 and 32 has an upper portion 52,54 extending above the open top 42. In a preferred embodiment, the axes of the rollers of the upper portion 52 lie in the same vertical plane as the axes of the rollers of the lower portion 46. Thus, the stack 28 comprises a set of vertically spaced idle rollers whose axes lie in a single vertical plane. Similarly, the axes of the rollers of the upper portion 54 lie in the same vertical plane as the axes of rollers in its corresponding lower portion (not shown). Thus, the stack of rollers 32 also comprises a set of vertically spaced rollers whose axes lie in a single vertical plane.

The second mutually opposing pair of roller stacks 30,34 has upper portions 56,58 which extend above the open top 42 and mutually diverge to form the funnel-like opening 26 with the upper portions 52,54. In FIGS. 1 and 2, the axes of each of the upper portions 56,58 form an inclined plane. Thus, the mutually diverging upper portions of rollers 56,58 permit the formation of the opening 26 which is larger in its lateral dimension than the open top 42. The larger size of the opening 26 is important for at least two reasons. First, the bag 10, as it enters the opening 26, is somewhat flattened on the conveyor 14 in its lateral dimension. Thus, the opening 26 is large enough to permit passage of the flattened bag. It should be understood that the funneling nature of the upper portions 56,58 reshapes the bag 10 to more closely approximate the shape of the box 36. Secondly, the opening 26 is large enough to catch an off-center bag and center it over the box. The upper portions 52, 54, 56, and 58 thereby form the large opening 26 to accommodate the bag 10 and guide and reshape it in funnel-like fashion downward into the box 36.

Located between the upper portion of rollers 58 and the lower portion of rollers 50, is a driven roller 60. Similarly, located at the junction between the upper portion of rollers 56 and the lower portion of rollers 48 is a driven roller 62. The driven rollers 60,62 are located adjacent to and above the open top 42. The location of the rollers 60,62 at the junction between the corresponding upper and lower portions 58,50 and 56,48, respectively, maximizes the surface area of the rollers 60,62 which contacts the bag 10 as the bag is guided through the open top 42. This surface area contact of the rollers 60,62 with the bag 10 is also maximized due to the larger diameter of the rollers 60,62 in relation to the idle rollers of the stacks 28, 30, 32, and 34. In one preferred embodiment, the diameter of the idle rollers of the stacks 28, 30, 32, and 34 is approximately three-eights inch, whereas the diameter of the driven rollers 60,62 is approximately two inches. Thus, the driven rollers 60,62 are several times larger in diameter than the idle rollers of the stacks 28, 30, 32, and 34.

In the preferred embodiment shown in FIGS. 1 and 2, the driven roller 60 is positioned approximately at the vertex of the angle formed by the upper portion of rollers 58 and the lower portion of rollers 50. Similarly, the driven roller 62 is approximately positioned at the vertex of the angle formed by the upper portion of rollers 56 and lower portion of rollers 48. Positioning of the driven rollers 60,62 at the vertex of these angles maximizes the surface area contact with the bag 10.

It should be understood that the upper portions of rollers 56 and 58 need not be mutually diverging. For example, the axes of the rollers in each portion 56,58 may form a vertical plane and be mutually spaced from one another a greater distance than the corresponding opposing sidewalls 40 of the box 36. Thus, the distance between the vertical upper portions 56 and 58 will be greater than the distance between the vertical lower portions 48 and 50. This ensures that the opening 26 formed by the upper portions 52, 54, 56, and 58 is larger than the open top 42. In this embodiment, the driven roller 60 would be positioned at the junction between the vertical upper portion 58 and the vertical lower portion 50 to form an angular transition therebetween. In this position, the surface area of the driven rollers 60 which contacts the bag 10 is maximized. Similarly, the driven roller 62 would be positioned to form an angular transition between the offset vertical upper and lower portions 56 and 48. In this embodiment, the driven rollers 60,62 form a funnel-like opening just above the box opening 42. Finally, if desired, the upper-most rollers of the vertical upper portions 56 and 58 may mutually diverge to form an even wider opening.

The driven rollers 60,62 can be driven by belts or other suitable means from a motor. The fact that the rollers 60,62 are of a large diameter and are driven, has been found to be an important element in the successful packaging of the bags. Thus, in a typical operation, the bag 10 is conveyed down the conveyor 14 into the opening 26. The upper portions of rollers 52, 54, 56, and 58 guide the bag 10 to the open top 42. At this point, i.e., just above the open top 42, the bag 10 contacts the driven rollers 60,62 which urge the bag 10 into the interior of the box 36. The lower portions of rollers 46,48,50 then convey the bag 10 to the bottom 38 of the box 36 by reducing the friction between the bag 10 and the sidewalls 40. The entire packaging operation requires less than about one-half a second to complete.

It should be understood that the stacks of rollers 28, 30, 32, and 34 are shown schematically in FIGS. 1 and 2 without any supporting structure. Referring to FIG. 3, a fragmentary view of a suitable supporting structure 64 is shown. The support structure 64 is an essentially L-shaped metal rail having spaced apertures 66. Each of the rollers has an axle 68 which extends through the apertures 66. Thus, each roller is rotatably supported by the structure 64. Each L-shaped rail structure 64 is located at each corner of the box 36, and is suspended above the bottom 38 of the box 36 at the midpoint of the box to accommodate the depth of the rollers. Each of the four L-shaped rails extends vertically upward to the open top 42 of the box 36. At this point, mutually opposing sides of the rails parallel to the driven rollers 60,62 will mutually diverge to allow space for the driven rollers 60,62. Above the rollers 60,62 the rail support system will conform to the geometry of the upper portions 52, 54, 56, and 58 of the roller stacks 28, 30, 32, and 34.

As discussed earlier, the lower portions of rollers 48 and 50 extend downward to a depth of about half the height of the box. This depth has been found experimentally to be preferred. However, it is believed that a depth between one-quarter to three-fourths of the height of the box would be acceptable. It is important, however, that the lower portions of rollers 46, 48, and 50 do not extend down into the box its entire length. This point is demonstrated in FIG. 4 in which the lower portion of rollers 48,50 are shown extending essentially to the bottom 38 of the box 36. In this situation, the lowermost rollers of the lower portions 48,50 prevent the base of the bag 10 from bulging outward. Thus, FIG. 4 can be contrasted with FIG. 2 in which the base of the bag 10 is allowed to bulge outward below the lower portions of rollers 48,50. Referring again to FIG. 4, since the base of the bag 10 is not permitted to bulge outward, the upper portion 70 of the bag 10 is forced outward. This bulging of the upper portion 70 of the bag 10 impedes the bag from being squeezed through the open top 42 and slows or stops the process. Thus, it is important that the base of the bag 10 be able to bulge which requires that the lower portion of rollers 46, 50, and 52 not extend down close to the bottom 38 of the box 36.

Referring to FIG. 5, the importance of the extension of the lower portions 46, 48, and 50 into the interior of the box is illustrated. Thus, in FIG. 5, the roller stacks 34 and 30 terminate just above the open top 42 and do not extend into the box 36. As a result, as the bag 10 descends into the box 36, an increasing surface area of the bag 10 contacts the sidewalls 40. Since the bag is being constrained by the sidewalls 40, the fluid within the bag 10 creates a hydraulic pressure which pushes the bag outward toward the sidewalls. This outward pressure increases the friction which exists between the sidewalls 40 and the bag 10 and becomes great enough to seriously impede the movement of the bag 10 downward toward the bottom 38 of the box 36. Thus, without the lower portion of rollers 36, 48, and 50 within the box 36, the packaging operation would require substantially more time to complete.

What is claimed is:

1. A roller chute for packaging a flexible bag filled with liquid in a container having an open top and sidewalls, comprising:

four stacks of rotatably supported, vertically spaced rollers, each of said stacks forming one of four sides of said chute, and each of said stacks having an upper portion and a lower portion, said lower portion stacks being oriented vertically;

said upper portion stacks extending upward above respective lower portion stacks, at least one opposing pair of said upper portion stacks inclined relative to the corresponding pair of said lower portion stacks to form a funnel-like opening for guiding said flexible containers into the opening formed by said lower portion stacks, said inclined pair of upper portion stacks forming a junction with the corresponding pair of said lower portion stacks; and a pair of power driven rollers for urging said flexible bag into said container, said rollers located at said junction to maximize the contact area between said rollers and said flexible bag as said bag is urged to said container by said rollers.

2. A roller chute for packaging a flexible bag filled with liquid in a container having an open top and sidewalls, comprising:

four stacks of rotatably supported, vertically spaced rollers, each of said stacks forming one of four sides of said chute, and each of said stacks having an upper portion and a lower portion;

said lower portion stacks oriented vertically, with opposing pairs of said stacks parallel and adjacent pairs of said stacks perpendicular;

said upper portion stacks extending upward above respective lower portion stacks, at least one opposing pair of said upper portion stacks inclined relative to the corresponding pair of said lower portion stacks to form a funnel-like opening for guiding said flexible containers into the opening formed by said lower portion stacks, said inclined pair of upper portion stacks forming a junction with the corresponding pair of said lower portion stacks; and a pair of power driven rollers for urging said flexible bag into said container, said rollers located at said junction to maximize the contact area between said rollers and said flexible bag as said bag is urged into said container by said rollers.

* * * * *